US005575943A

United States Patent [19]

Lee

[11] Patent Number: 5,575,943

[45] Date of Patent: Nov. 19, 1996

[54] MICROWAVE OVEN WITH A SINGLE THERMOSTAT TO SENSE TEMPERATURE OF BOTH THE MAGNETRON AND THE MICROWAVE CAVITY

[75] Inventor: Jong W. Lee, Kyungsangnam-Do, Rep. of Korea

[73] Assignee: LG Electronics Inc., Rep. of Korea

[21] Appl. No.: 498,592

[22] Filed: Jul. 6, 1995

[30] Foreign Application Priority Data

Jul. 6, 1994 [KR] Rep. of Korea ..... 16683/1994

[51] Int. Cl.[6] ..... H05B 6/68

[52] U.S. Cl. ..... 219/710; 219/757; 219/761

[58] Field of Search ..... 219/710, 711, 219/707, 723, 757, 704, 705, 761

[56] References Cited

U.S. PATENT DOCUMENTS

| | | | |
|---|---|---|---|
| 3,829,649 | 8/1974 | Igarashi | 219/757 |
| 3,875,361 | 4/1975 | Fukui et al. | 219/710 |
| 4,162,381 | 7/1979 | Buck | 219/707 |
| 4,661,669 | 4/1987 | Matsushima et al. | 219/757 |
| 4,882,462 | 11/1989 | Husslein et al. | 219/10.55 B |
| 5,140,120 | 8/1992 | Kasai et al. | 219/710 |
| 5,378,876 | 1/1995 | Kitagawa | 219/710 |

FOREIGN PATENT DOCUMENTS

| | | | |
|---|---|---|---|
| 53-34152 | 3/1978 | Japan | 219/710 |
| 2-302524 | 12/1990 | Japan | 219/710 |

*Primary Examiner*—Philip H. Leung

*Attorney, Agent, or Firm*—Ostrolenk, Faber, Gerb & Soffen, LLP

[57] ABSTRACT

This invention discloses an improved safety device for microwave oven having one thermostat commonly preventing possible overheat of the cavity and magnetron of the microwave oven. The thermostat is placed in a position suitable for sensing both a peripheral temperature of a magnetron and a temperature of an air exhausted from a heating cavity through an air exhaust port. The thermostat cuts off the outside electric power for the microwave oven when the peripheral temperature of the magnetron or the temperature of the exhaust air coming out of the heating cavity is higher than a predetermined allowable temperature. The air exhaust port is provided about the magnetron. The thermostat mounting bracket is connected to the magnetron mounting bracket.

4 Claims, 4 Drawing Sheets

MICROWAVE OVEN WITH A SINGLE THERMOSTAT TO SENSE TEMPERATURE OF BOTH THE MAGNETRON AND THE MICROWAVE CAVITY

BACKGROUND OF THE INVENTION

1. Field of the Invention

The present invention relates in general to a safety device for an microwave oven and, more particularly, to a structural improvement in such a safety device for simplifying the structure of the microwave oven and reliably preventing possible damage of the microwave oven caused by overheat of either the magnetron or the heating cavity of the microwave oven.

2. Description of the Prior Art

Typical microwave oven may have danger of a fire in their cavities due to careless operation of the users or forcible operation under the abnormal conditions of the microwave ovens. When the microwave oven is carelessly operated with no food charged in the heating cavity of the microwave oven, the microwave emitted from the magnetron returns to the magnetron due to no food to be heated in the cavity. When the magnetron is overheated as described above, the magnetron will be overheated to be seriously damaged.

In an effort to combat the above problems of the typical microwave ovens, the microwave ovens are preferably provided with their safety devices. With reference to FIGS. 1A and 1B, there is shown an microwave oven with a typical safety device. As shown in these drawings, the microwave oven includes a heating cavity 100 which will be charged with food to be heated and cooked by the microwave energy. A magnetron 110 is mounted to a side of the cavity 100 and generates the microwave used for heating the food in the cavity 100. The microwave oven also includes an air exhaust port 120 which is formed in the top wall of the cavity 100 such that the port 120 is opposite to the magnetron 110. The port 120 is used for exhausting the air of the cavity 100 to the outside. An oven thermostat 130 is provided on the top wall of the cavity 100 about the exhaust port 120 and used for sensing the inner temperature of the cavity 100 by checking the air exhausted from the cavity 100 through the port 120. The thermostat 130 has a bimetal structure which will cut off the electric power for the microwave oven when the thermostat 130 senses that the inner temperature of the cavity 100 is abnormally increased. The microwave oven further includes a magnetron thermostat 140 which is provided about the magnetron 110 and used for cutting off the outside electric power for the magnetron 110 when the temperature of the magnetron 110 is higher than a predetermined allowable temperature. In the above drawings, the reference numeral 150 denotes a casing which surrounds and protects the parts of the microwave oven and the numeral 160 denotes an air suction port which is formed in the cavity wall and used for sucking the outside air into the cavity 100 therethrough.

Turning to FIG. 2, there is shown a circuit of the typical safety device provided in the microwave oven of FIG. 1A. The above safety device includes a power plug 200 and a fuse 210. The oven thermostat 130, which will cut off the electric power for the microwave oven when the temperature of the exhaust air discharged from the cavity 100 through the port 120 is higher than the allowable temperature, is included in the safety device. The safety device also includes the magnetron thermostat 140 which will cut off the outside electric power for the magnetron 110 when the temperature of the magnetron 110 is higher than the allowable temperature. The circuit of the safety device is controlled by a control unit 220. The device further includes a first switch 230, an oven lamp 240, a fan motor 250, a turntable motor 260, a second switch 270, a transformer 280, a high voltage capacitor 290 and the magnetron 110. The first switch 230 selectively opens the circuit to stop the magnetron 110 when the door of the microwave oven is opened. The oven lamp 240 lights the inside of the cavity 110. The fan motor 250 generates the rotational force for sucking and exhausting the air relative to the cavity 100, while the turntable motor 260 generates the rotational force for rotating a food turntable (not shown) in the cavity 100. The second switch 170 is a safety switch which will cut the fuse 210 and open the circuit when the first switch 230 is out of order. The transformer 180 converts the input voltage into a high voltage. The high voltage capacitor 190 doubles the high voltage of the transformer 280 prior to applying the voltage to the magnetron 110. The magnetron 110 is applied with the high voltage from both the transformer 280 and the high voltage capacitor 290 and generates the microwave for heating the food laid on the turntable in the cavity 100.

The control unit 220 in turn includes a first connector 221 for connecting the outside electric power to first and second internal relays 222 and 223. The first relay 222 selectively relays the outside electric power to a function control panel (not shown) of the microwave oven as desired. The second relay 223 relays the input power to all of the oven lamp 240, the fan motor 250 and the turntable motor 260. The control unit 220 also includes a third relay 224 which controls the operation of the magnetron 110 and in turn controls the output of the magnetron 110. The control unit 220 further includes a second connector 225 which connects the output electric power to a control switch 226. The control switch 226 is for controlling the operation of the relays 223 and 224.

In operation of the above electronic microwave oven, the range is applied with the outside electric power through the plug 200 and performs a cooking mode which is selected by the user by operating the function control panel (not shown). When the selected cooking mode is performed, the air sucked into the cavity 100 through the air suction port 160 as shown in FIG. 1B and heated in the cavity 100 by the microwave of the magnetron 110. The heated air is, thereafter, exhausted to the outside of the cavity 100 through the air exhaust port 120. In the case, when the temperature of the exhaust air discharged from the cavity 100 through the port 120 is higher than the allowable temperature, the oven thermostat 130 senses the overheated exhaust air temperature and cuts off the outside electric power for the microwave oven and thereby preventing possible overheat of the cavity 100.

When the microwave oven is carelessly operated with no food charged in the cavity 100, the microwave emitted from the magnetron 110 will return to the magnetron 110 and overheat the magnetron 110. In order to prevent such an overheat of the magnetron 110, the magnetron thermostat 140 is provided about the magnetron 110 and checks the peripheral temperature of the magnetron 110. In the same manner as described for the oven thermostat 130, the magnetron thermostat 140 cuts off the outside electric power for the magnetron 110 when the magnetron temperature is higher than the allowable temperature and thereby prevent possible overheat of the magnetron 110.

However, the above safety device for a microwave oven has a problem in that the safety device for a microwave oven has a complicated construction and increases the cost because the microwave oven device separately includes two thermostats 130 and 140, which are used for preventing possible overheat of the cavity 100 and possible overheat of the magnetron 110 respectively, even though the functions of the two thermostats 130 and 140 are practically same with each other.

SUMMARY OF THE INVENTION

It is, therefore, an object of the present invention to provide a safety device for microwave oven in which the above problems can be overcome and which has one thermostat commonly prevent possible overheat of the cavity and magnetron.

In order to accomplish the above object, the present invention provides a safety device for microwave oven comprising a thermostat placed in a suitable position in a bracket sensing both the peripheral temperature of a magnetron and the inner temperature of a heating cavity and adapted for cutting off the outside electric power for the microwave oven when the peripheral temperature of the magnetron or the inner temperature of the cavity is higher than a predetermined allowable temperature.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1A:
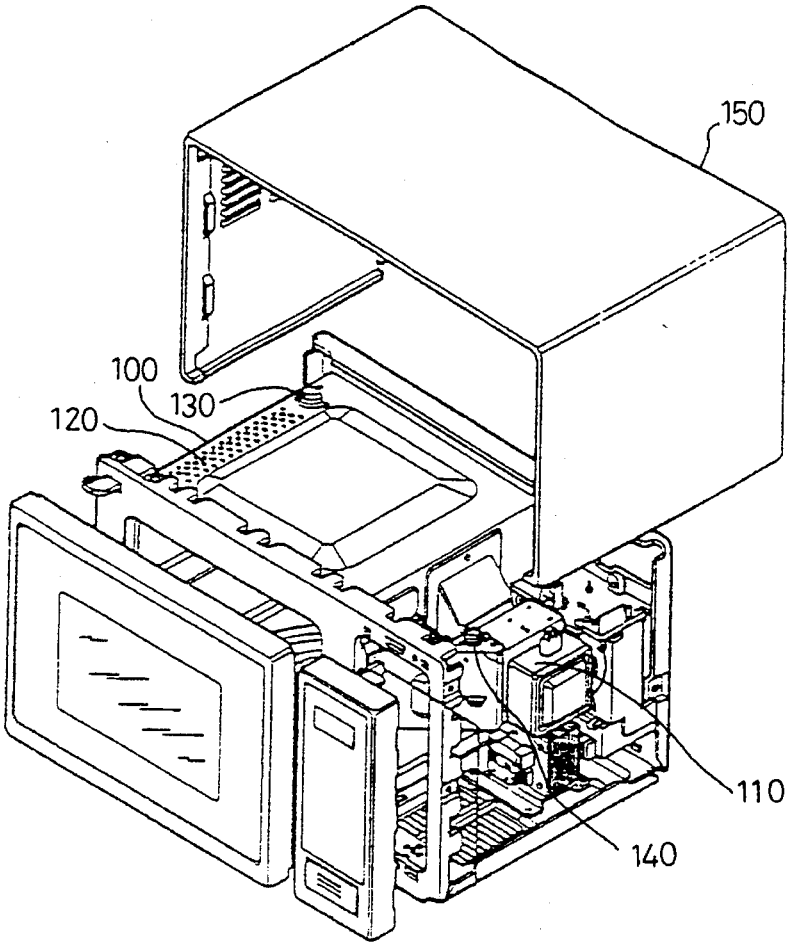
FIG. 1A CONVENTIONAL ART
FIG. 1A is a partially exploded perspective view of an microwave oven with a typical safety device separately including a magnetron thermostat and an oven thermostat.
Figure 1B:
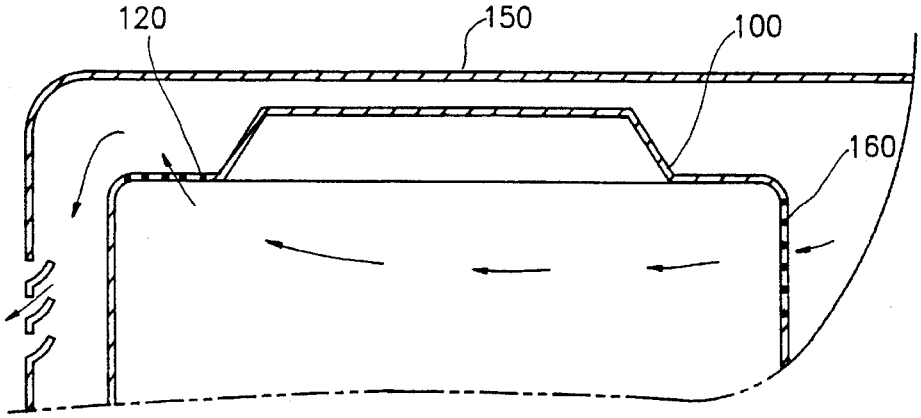
FIG. 1B CONVENTIONAL ART
FIG. 1B is a sectional view of the top section of the microwave oven of FIG. 1A, showing the circulation of the air through an air suction port and an air exhaust port in a cooking mode of the range.
Figure 2:
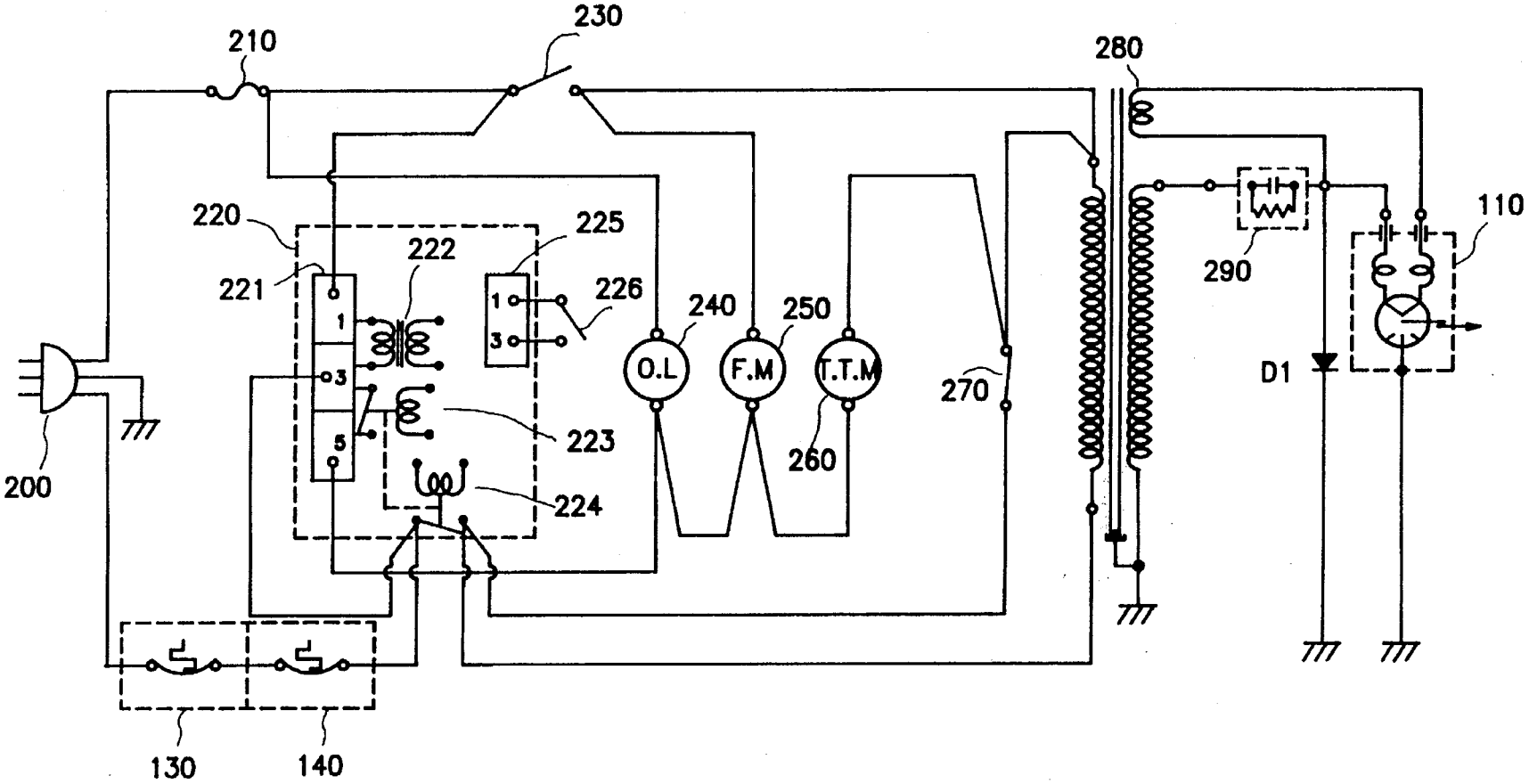
FIG. 2 CONVENTIONAL ART
FIG. 2 is a circuit diagram of the safety device provided in the microwave oven of FIG. 1A.
Figure 3A:
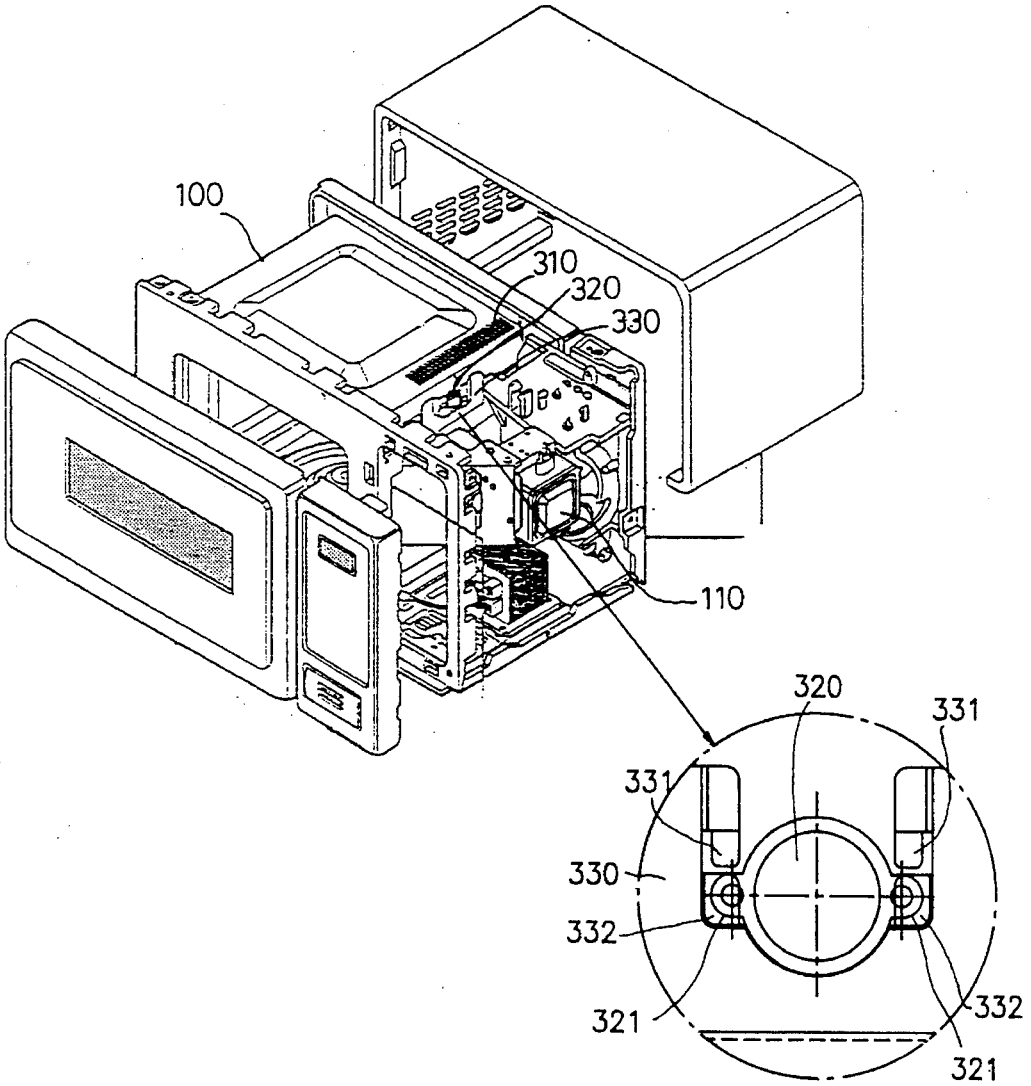
FIG. 3A is a partially exploded perspective view of a microwave oven in accordance with a preferred embodiment of the present invention.
Figure 3B:
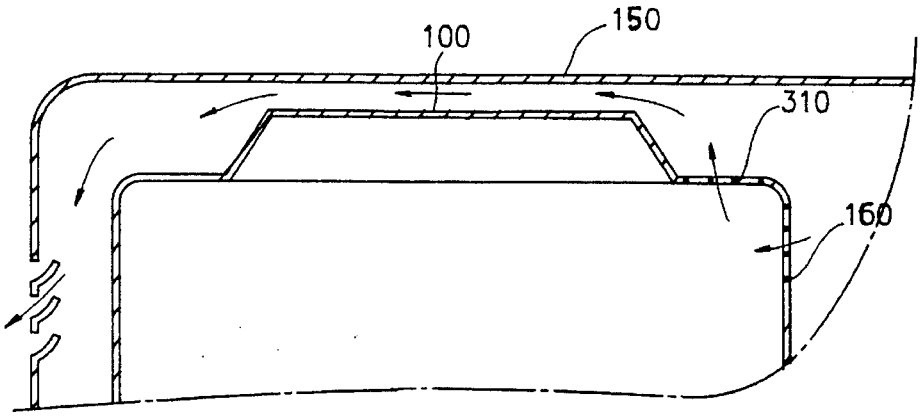
FIG. 3B is a sectional view of the top section of the microwave oven of FIG. 3A, showing the circulation of the air through an air suction port and an air exhaust port in a cooking mode of the microwave oven.
Figure 4:
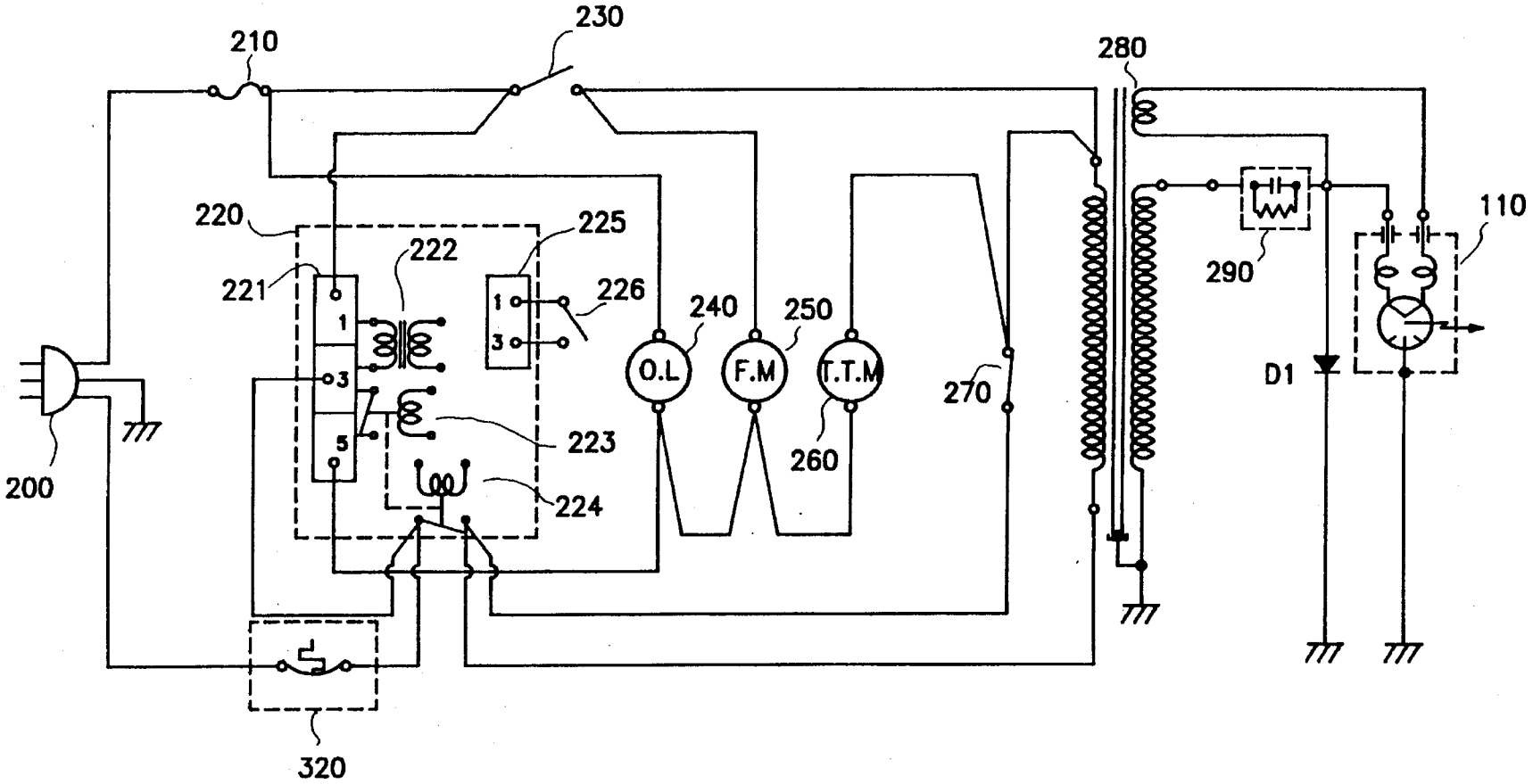
FIG. 4 is a circuit diagram of the safety device provided in the microwave oven of FIG. 3A.

With reference to FIGS. 3A and 3B, there is shown an electronic range with a safety device in accordance with a preferred embodiment of the present invention. As shown in these drawings, the safety device for a microwave oven of this invention includes the cavity 100 and the magnetron 110 in the same manner as described for the prior art range of FIG. 1A. However, the air exhaust port 310 of this microwave oven for discharging the air from the cavity 100 is formed on the top of the cavity 100 about the magnetron 110 differently from the prior art microwave oven. The device of this invention also includes a thermostat 320 which is mounted to a side wall of the cavity 100 about the magnetron 110 by means of a thermostat bracket 330. The thermostat 320, which is placed in a position suitable for sensing both the peripheral temperature of the magnetron 110 and the inner temperature of the cavity 100, cuts off the outside electric power for the microwave oven when at least one of the peripheral temperature of the magnetron 110 and the inner temperature of the cavity 100 is higher than a predetermined allowable temperature. In the above safety device for a microwave oven, the bracket 330 for mounting the thermostat 320 to the side wall of the cavity 100 is connected to a magnetron bracket (not shown) for mounting the magnetron 110. The temperature of the magnetron 110 is thus easily transmitted to the thermostat 320 through the connected brackets. The enlarged and encircled part of FIG. 3A shows an embodiment of a structure for mounting the thermostat 320 to the side wall of the cavity 100 using the bracket 330. That is, the opposite bosses 321 of the thermostat 320 are seated in and held by the opposite supports 332 of the bracket 330 respectively. After holding the opposite bosses 321 of the thermostat 320 on the supports 332 of the bracket 330, opposite elastic fixing members 331 of the bracket 330 elastically fix the position of the coupling parts 321 downward so that the thermostat 320 is prevented from vertical vibration in the bracket 330. FIG. 4 is a circuit diagram of the safety device provided in the microwave oven of FIG. 3A. As shown in the circuit diagram of FIG. 4, the general elements of the circuit of the safety device for a microwave oven of this invention remain the same as described for the circuit of the prior art microwave oven of FIG. 2, but one thermostat 230 is substituted for the two thermostats, that is, the oven thermostat 130 and magnetron thermostat 140, of the prior art microwave oven.

In operation of the above microwave oven, the range is applied with the outside electric power through the plug 200 and performs a cooking mode which is selected by the user by operating the function control panel (not shown). When the selected cooking mode is performed, the air sucked into the cavity 100 through the air suction port 160 as shown in FIG. 3B and heated in the cavity 100 by the microwave of the magnetron 110. The heated air is, thereafter, exhausted to the outside of the cavity 100 through the air exhaust port 310. In the safety device of the invention, the air exhaust port 310 for discharging the air from the cavity 100 is formed on the top of the cavity 100 about the magnetron 110 such that the thermostat 320 readily senses both the peripheral temperature of the magnetron 110 and the inner temperature of the cavity 100 differently from the prior art microwave oven. In this regard, when the temperature of the exhaust air discharged from the cavity 100 through the port 310 is higher than the allowable temperature, the thermostat 320 cuts off the outside electric power for the microwave oven and thereby preventing possible overheat of the cavity 100.

When the microwave oven is carelessly operated with no food charged in the cavity 100, the microwave emitted from the magnetron 110 will return to the magnetron 110 and overheat the magnetron 110. When the magnetron 110 is overheated as described above to increase the peripheral temperature of the magnetron 110, the peripheral temperature of the magnetron 110 is transmitted to the thermostat 320 through the brackets 330. When the temperature of the magnetron 110 sensed by the thermostat 320 is higher than the predetermined allowable temperature, the thermostat 320 cuts off the outside electric power for the magnetron 110 and thereby preventing possible overheat of the magnetron 110.

As described above, the present invention provides an improved safety device for microwave oven which has one thermostat commonly functioning as the prior art oven thermostat for preventing possible overheat of the heating cavity and as the prior art magnetron thermostat for preventing possible overheat of the magnetron. Therefore, the safety device of this invention has a simple construction and cuts down the cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In a microwave oven having a heating cavity wherein food to be heated is placed and a magnetron for generating microwave energy to the heated cavity for heating the food placed therein, a safety device comprising:

a single thermostatic switch operably connected for switching an external supply of electric power to the microwave oven, the thermostatic switch being mounted to a sidewall of the heating cavity proximate the magnetron by means of a thermostat bracket for thereby enabling the thermostatic switch to sense a temperature of the heating cavity, the thermostat bracket being connected to a magnetron bracket for mounting the magnetron, whereby the temperature of the magnetron is transmitted to the thermostatic switch through the connected magnetron bracket and thermostat bracket for thereby enabling the thermostatic switch to also sense the temperature of the magnetron, the thermostatic switch being operable for cutting off the external supply of power to the microwave oven when at least one of the respective temperatures of the heating cavity and the temperature of the magnetron exceeds a predetermined temperature.

2. The microwave oven according to claim 1, wherein an air exhaust port for discharging air from the heating cavity is formed in a top region of the heating cavity proximate the magnetron.

3. The microwave oven according to claim 1, wherein the temperature of the heating cavity sensed by the thermostatic switch is the temperature inside the heating cavity.

4. The microwave oven according to claim 1, wherein the temperature of the magnetron sensed by the thermostatic switch is a peripheral temperature of the magnetron.

* * * * *